US006478002B1

(12) United States Patent
Mashiko

(10) Patent No.: US 6,478,002 B1
(45) Date of Patent: Nov. 12, 2002

(54) ENGINE FOR WATERCRAFT

(75) Inventor: Tetsuya Mashiko, Shizuoka (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/676,922

(22) Filed: Oct. 2, 2000

(30) Foreign Application Priority Data

Sep. 30, 1999 (JP) ..... 11-277911

(51) Int. Cl.[7] ..... F02M 35/10
(52) U.S. Cl. ..... 123/184.42; 440/88
(58) Field of Search ..... 440/88; 123/184.21, 123/184.42

(56) References Cited

U.S. PATENT DOCUMENTS 5,340,344 A 8/1994 Mineo et al.
5,477,819 A 12/1995 Kopec ..... 123/184.42
5,655,500 A 8/1997 Kato
5,899,779 A * 5/1999 Hattori ..... 440/88
5,902,161 A 5/1999 Nakase
5,908,337 A 6/1999 Mashiko
5,921,225 A 7/1999 Nakamura
6,067,953 A * 5/2000 Bloomer ..... 123/184.21

* cited by examiner

*Primary Examiner*—Noah P. Kamen
(74) *Attorney, Agent, or Firm*—Knobbe, Martens, Olson & Bear, LLP

(57) ABSTRACT

An engine for a watercraft includes an improved air induction system that can have a large plenum chamber notwithstanding being placed in a narrow engine compartment. The air induction system includes a plenum chamber member defining the plenum chamber. The plenum chamber member has an air inlet port for the plenum chamber. The air induction system also includes one or more throttle bodies. The throttle bodies have throttle valves admitting air to one or more combustion chambers from the plenum chamber. The throttle bodies are disposed within the plenum chamber. The construction of the air induction system not only provide a large capacity plenum chamber, but also protects the throttle bodies from water.

19 Claims, 5 Drawing Sheets

ENGINE FOR WATERCRAFT

PRIORITY INFORMATION

This invention is based on and claims priority to Japanese Patent Applications No. Hei 11-277911, filed Sep. 30, 1999, the entire contents of which is hereby expressly incorporated by reference.

BACKGROUND OF THE INVENTION

1. Field of the Invention

This invention relates to an engine for a watercraft, and more particularly to an arrangement of an air induction system of an engine most suitable for a personal watercraft.

2. Description of Related Art

Personal watercrafts have become very popular in recent years. This type of watercraft is quite sporting in nature and caries one or more riders. A relatively small hull of the personal watercraft commonly defines a rider's area above an engine compartment. An internal combustion engine powers a jet propulsion unit which propels the watercraft. The engine lies within the engine compartment in front of a tunnel formed on an underside of the hull. The jet propulsion unit, which includes an impeller, is placed within the tunnel. The impeller has an impeller shaft driven by the engine. The impeller shaft usually extends between the engine and the jet propulsion device through a bulkhead of the hull tunnel.

The engine includes an air induction system for introducing air into one or more combustion chambers. The air induction system includes one or more throttle bodies associated with the combustion chambers. Each throttle body has a throttle valve admitting air into the combustion chambers. Typical throttle bodies are made of metal material. This metal material, however, is likely to be corroded by water, particularly, by salt water. Because the engine for the watercraft often is exposed to water, water protection of engine components is a concern.

A need therefore exists for an improved engine that can protect a throttle body or throttle bodies from water so as to preclude the throttle bodies from corrosion.

In addition, although personal watercraft with a four-cycle engine are now being designed primarily for reducing exhaust emissions. The four-cycle engine normally needs a plenum chamber that has a relatively large volume so as to obtain high performance under all running conditions. The four-cycle engine, however, has two or more valves and a valve drive mechanism arranged to activate the valves. Such a large plenum chamber, multiple valves and a valve drive mechanism, as well as the foregoing throttle bodies, are thus factors that make the engine larger in height and/or in width. On the other hand, because the rider's area is defined above the engine compartment as noted above, the capacity and height of the engine compartment is extremely limited. Otherwise, the seat position must be higher and/or wider and this is not comfortable for the rider.

Another need therefore exists for an improved engine, particularly, an improved four-cycle engine but not limited thereto, that can have a relatively large plenum chamber notwithstanding having a number of engine components greater than a two-cycle engine and notwithstanding being placed in a relatively narrow engine compartment.

SUMMARY OF THE INVENTION

In accordance with one aspect of the present invention, an internal combustion engine is provided for a watercraft that has a hull defining an engine compartment in which the engine is placed. The engine comprises a cylinder block defining at least one cylinder bore. A piston reciprocates within the cylinder bore. A cylinder head member closes an end of the cylinder bore and defines a combustion chamber with the cylinder bore and the piston. An air induction system is arranged to introduce air to the combustion chamber. The air induction system includes a plenum chamber member defining a plenum chamber. The plenum chamber member has an air inlet port for the plenum chamber. A throttle body has a throttle valve admitting air to the combustion chamber from the plenum chamber. The throttle body is disposed within the plenum chamber.

In accordance with another aspect of the present invention, a watercraft comprises a hull defining an engine compartment and a rider's area above the engine compartment. An internal combustion engine is disposed within the engine compartment. The engine includes an engine body in which a combustion chamber is defined. An air induction system is arranged to introduce air to the combustion chamber. The air induction system includes a plenum chamber member and a throttle body. The plenum chamber member defines a plenum chamber and has an air inlet port. The throttle body has a throttle valve admitting air to the combustion chamber from the plenum chamber. The throttle body is positioned within the plenum chamber.

Further aspects, features and advantages of this invention will become apparent from the detailed description of the preferred embodiment which follows.

BRIEF DESCRIPTION OF THE DRAWINGS

These and other features of this invention will now be described with reference to drawings of a preferred embodiment which is intended to illustrate and not to limit the invention. The drawings contain the following figures.

DETAILED DESCRIPTION OF THE PREFERRED EMBODIMENT OF THE INVENTION

With reference to FIGS. 1 to 5, a personal watercraft 30 employs an internal combustion engine 32 configured in accordance with a preferred embodiment of the present invention. The engine configuration has particular utility with the personal watercraft, and thus, is described in the context of the personal watercraft. The engine configuration, however, can be applied to other types of watercrafts as well, such as, for example, small jet boats.

Figure 1:
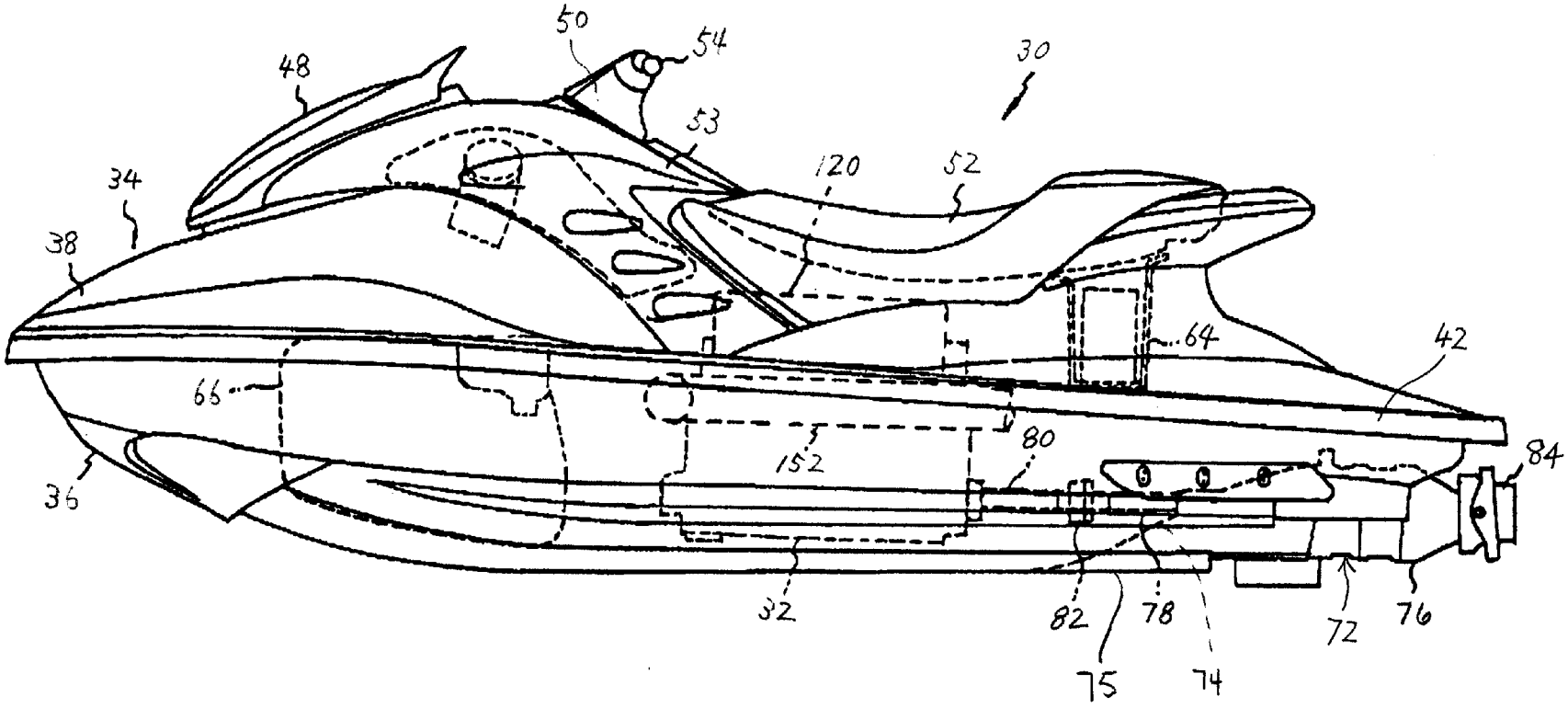
FIG. 1 is a side elevational view of a personal watercraft of the type powered by an engine configured in accordance with a preferred embodiment of the present invention. Several of the internal components of the watercraft (e.g., the engine) are illustrated in phantom.
Figure 2:
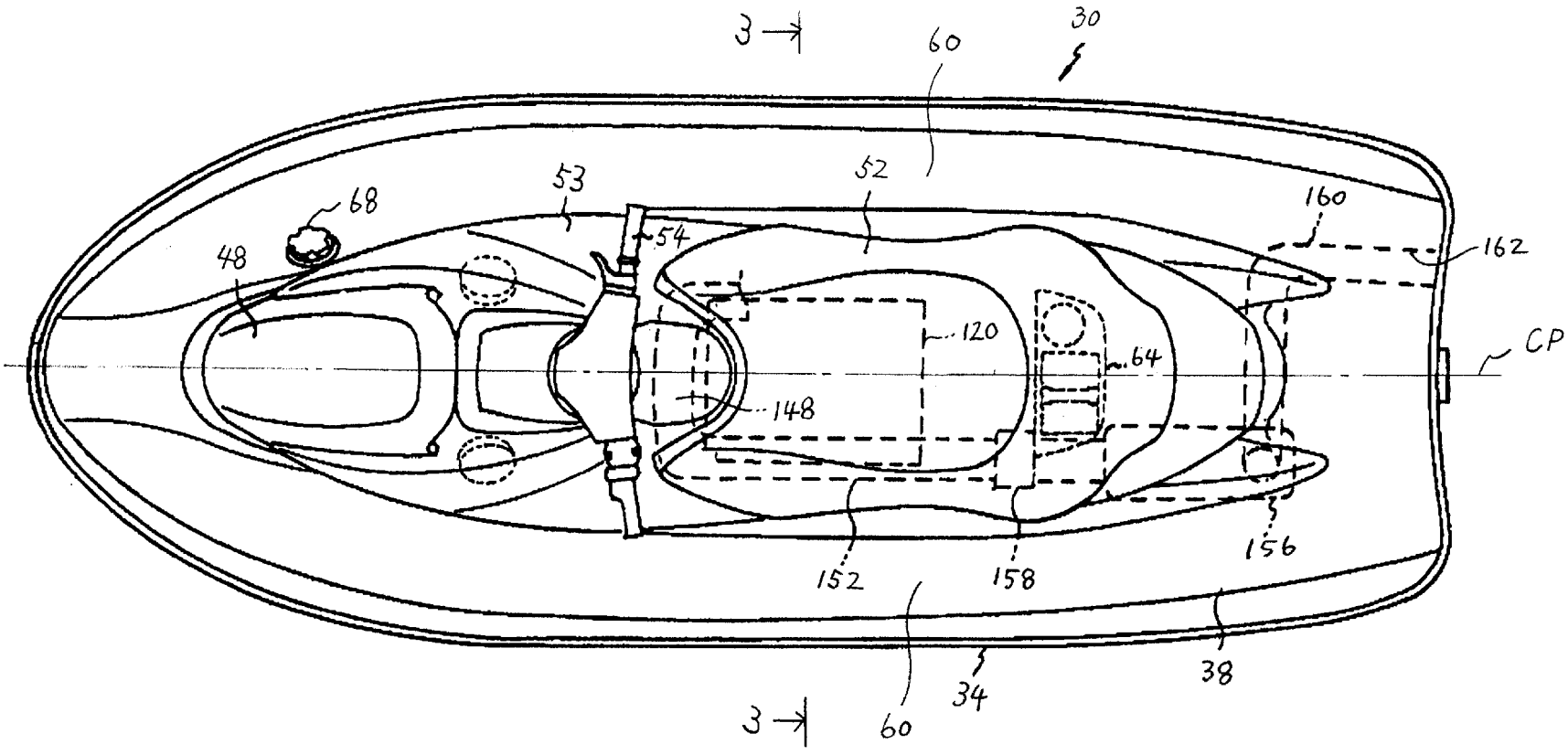
FIG. 2 is a top plan view of the watercraft.
Figure 3:
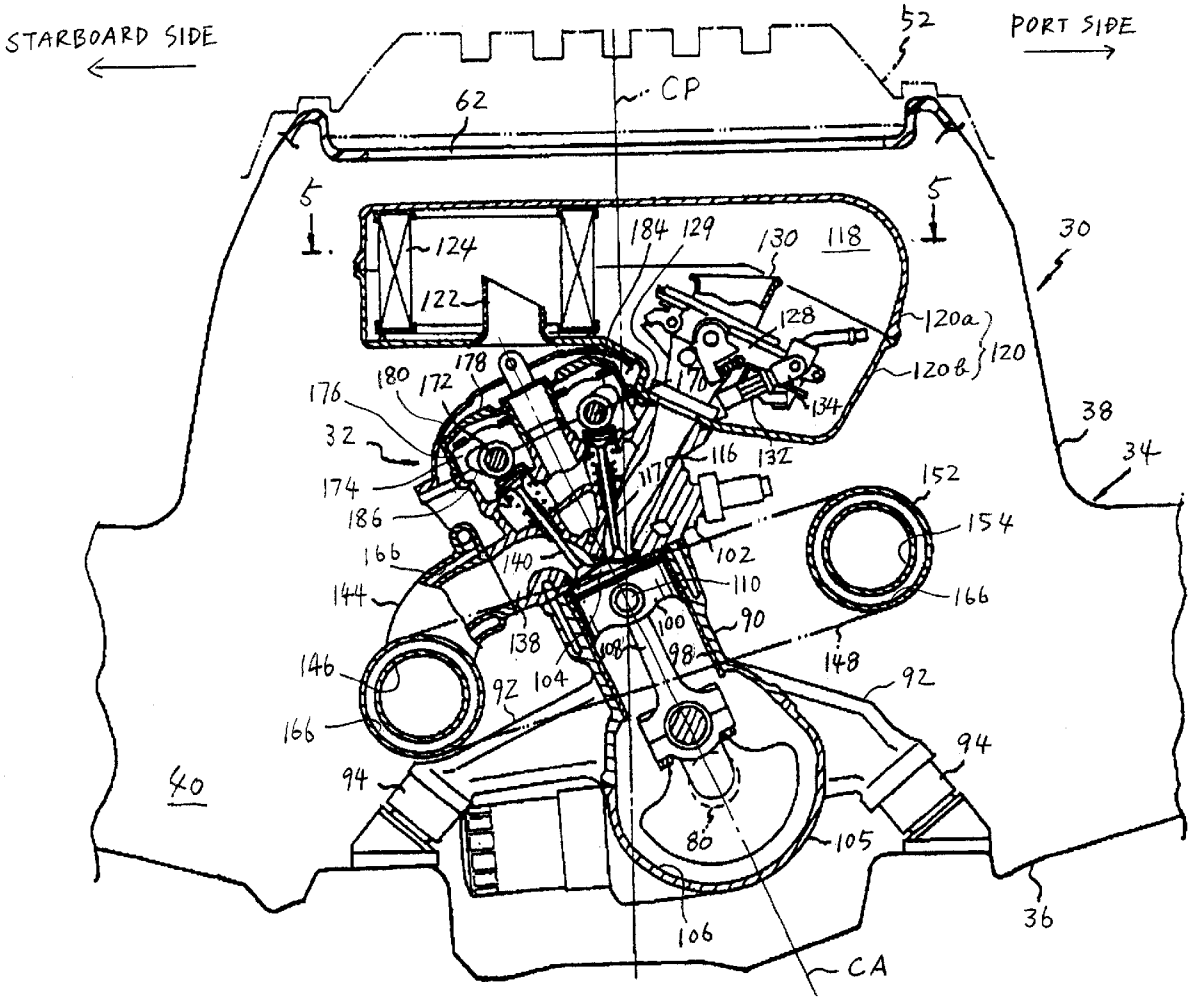
FIG. 3 is a schematic, cross-sectional front view of the watercraft and the engine taken along the line 3—3 of FIG. 2. A profile of a hull of the watercraft is shown schematically except for an opening of an engine compartment. A seat is illustrated in phantom. In this figure, the right-hand side is the port side of the watercraft, while the left-hand side is the starboard side thereof.

With initial reference to FIGS. 1 to 3, the personal watercraft 30 includes a hull 34 generally formed with a lower hull section 36 and an upper hull section or deck 38. Both the hull sections 36, 38 are made of, for example, a molded fiberglass reinforced resin or a sheet molding compound. The lower hull section 36 and the upper hull section 38 are coupled together to define an internal cavity 40. A gunnel 42 defines an intersection of both the hull sections 36, 38.

As seen in FIGS. 2 and 3, the hull 34 defines a center plane CP that extends generally vertically from bow to stem. Along the center plane CP, the upper hull section 34 includes a hutch cover 48, a control mast 50 and a seat 52 one after another from fore to aft.

In the illustrated embodiment, a bow portion 53 of the upper hull section 38 slopes upwardly and an opening is provided through which the rider can access the internal cavity 40. The hutch cover 48 is detachably affixed (e.g., hinged) to the bow portion 53 so as to cover the opening.

The control mast 50 extends generally upwardly almost atop the bow portion 53 to support a handle bar 54. The handle bar 54 is primarily provided for controlling the directions in which the water jet propels the watercraft 30. The handle bar 54 also carries other control units such as, for example, a throttle lever 56 that is used for control of running conditions of the engine 32.

The seat 52 extends along the center plane CP in the rear of the bow portion 53. This area in which the seat 52 is positioned is a rider's area. The seat 52 has a saddle shape and hence the rider can straddle it. Foot areas 60 are defined on both sides of the seat 52 and at the top surface of the upper hull section 38. The foot areas 60 are formed generally flat. A cushion supported by the upper hull section 38, at least in principal part, forms the seat 52. The seat 52 is detachably attached to the upper hull section 38. An access opening 62 is defined under the seat 52 through which the rider can also access the internal cavity 40. That is, the seat 52 usually closes the access opening 62. In the illustrated embodiment, the upper hull section 38 also defines a storage box 64 under the seat 52.

A fuel tank 66 is placed in the cavity 40 under the bow portion 53 of the upper hull section 38. The fuel tank 66 is coupled with a fuel inlet port positioned at a top surface of the upper hull section 38 through a duct. A closure cap 68 closes the fuel inlet port. The opening disposed under the hutch cover 48 is available for accessing the fuel tank 66.

The engine 32 is placed in an engine compartment defined in the cavity 40. The engine compartment preferably is located under the seat 52, but other locations are also possible (beneath the control mast or in the bow). The rider thus can access the engine 32 in the illustrated embodiment through the access opening 62 by detaching the seat 52. At least one air duct is provided at the bow portion 53 so that the ambient air can enter the internal cavity 40 therethrough. Except for the air duct(s), the engine compartment is substantially sealed so as to protect the engine 32 and a fuel supply system, including the fuel supply tank 66, from water.

A jet pump unit 72 propels the watercraft 30. The jet pump unit 72 includes a tunnel 74 formed on the underside of the lower hull section 36 which is isolated from the engine compartment by a bulkhead. The tunnel has a downward facing inlet port 75 opening toward the body of water. A jet pump housing 76 is disposed within a portion of the tunnel 74 and communicates with the inlet port 75. An impeller is supported with the housing 76. An impeller shaft 78 extends forwardly from the impeller and is coupled with a crankshaft 80 of the engine 32 by a coupling member 82. The crankshaft 80 of the engine 32 thus drives the impeller shaft 78. The rear end of the housing 76 defines a discharge nozzle and a steering nozzle 84 is affixed to the discharge nozzle for pivotal movement about a steering axis extending generally vertically. The steering nozzle 84 is connected to the handle bar 54 by a cable so that the rider can steer the nozzle 84.

When the engine 32 drives the impeller shaft 78 and hence the impeller rotates, water is drawn from the surrounding body of water through the inlet port 75. The pressure generated in the housing 76 by the impeller produces a jet of water that is discharged through the discharge nozzle 84. This water jet propels the watercraft 30. The rider can move the steering nozzle 84 with the handle bar 54 when he or she desires to turn the watercraft 30 in either direction.

Figure 4:
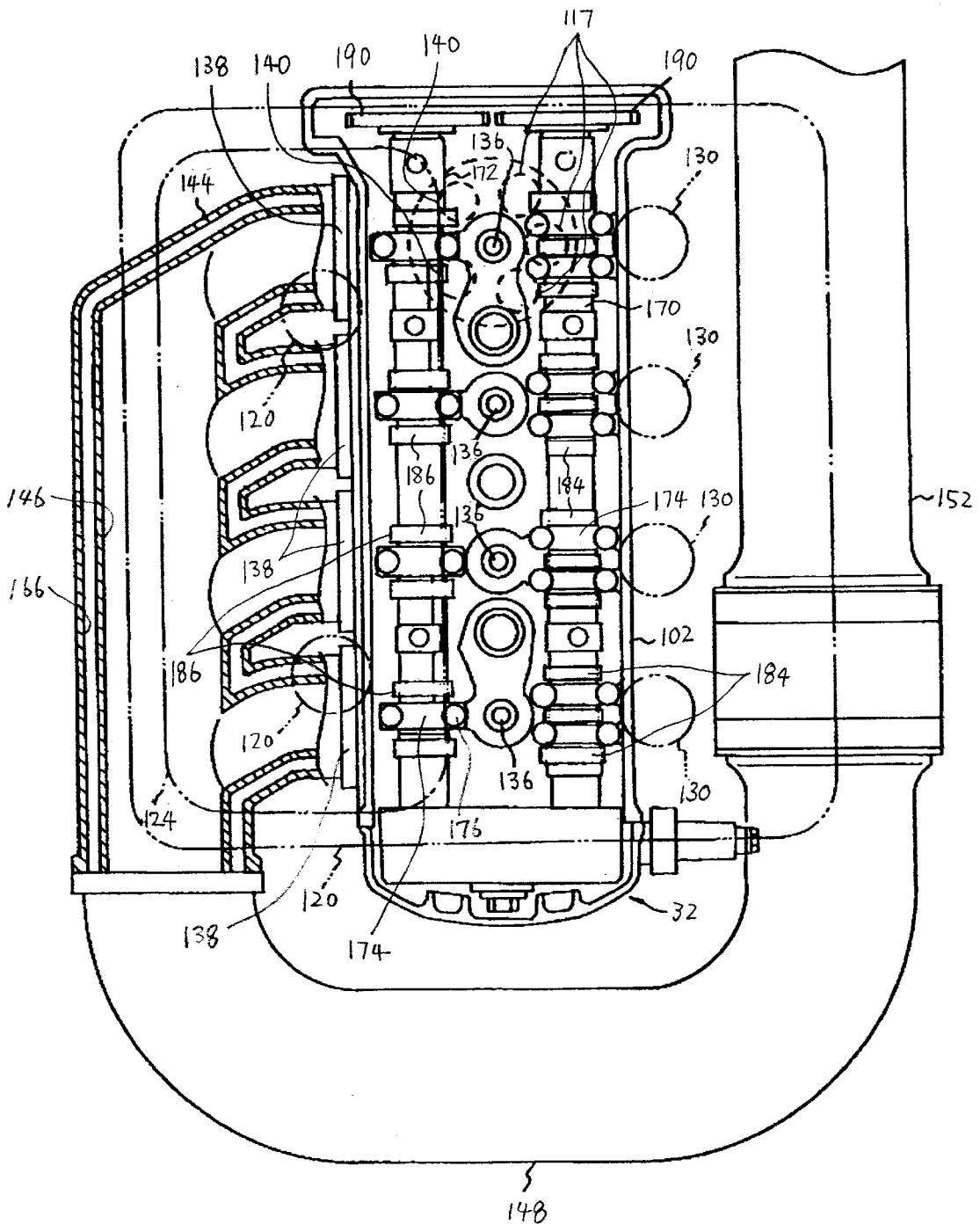
FIG. 4 is an enlarged, top plan view of the engine. A cylinder head cover member and cam chamber housings are removed. A plenum chamber and an air cleaner element are shown in phantom.

Still with reference to FIGS. 1 to 3 and additionally with reference to FIGS. 4 and 5, the engine 32 will now be described in great detail. The engine 32 operates on a four-stroke cycle combustion principle. The engine 32 includes a cylinder block 90. Engine mounts 92 extend from both sides of the cylinder block 90 and have elastic members 94 made of, for example, rubber material at end portions thereof. The engine 32 is mounted on the lower hull section 36 through the engine mounts 92 via the elastic members 94.

The cylinder block 90 defines four cylinder bores 98 spaced apart from each other from fore to aft along the center plane CP. The engine 32 thus is a L4 (in-line four cylinder) type. The illustrated engine, however, merely exemplifies one type of engine on which various aspects and features of the present invention can be used. Engines having other number of cylinders, having other cylinder arrangements, other cylinder orientations (e.g., upright cylinder banks) and operating on other combustion principles (e.g., crankcase compression two-stroke or rotary) are all practicable.

Each cylinder bores 98 has a center axis CA that is slanted or inclined at a certain angle from the center plane CP so that the engine 32 can be short in height. All the center axes CA in the illustrated embodiment have the same angle. Pistons 100 reciprocate within the cylinder bores 98. A cylinder head member 102 is affixed to the upper end of the cylinder block 90 to close respective upper ends of the cylinder bores 98 and defines combustion chambers 104 with cylinder bores 98 and the pistons 100.

A crankcase member 105 is affixed to the lower end of the cylinder block 90 to close the respective lower ends of the cylinder bores 98 and to define a crankcase chamber 106 with the cylinder block 90. The crankshaft 80 is rotatably connected to the pistons 100 through connecting rods 108 and jounaled by the crankcase member 105. That is, the connecting rods 108 are rotatably coupled with the pistons 100 by piston pins 110 and with the crankshaft 80. The crankshaft 80 rotates with the reciprocal movement of the pistons 100 between a top dead center position and a bottom dead center position. In the illustrated embodiment, axes of the respective piston pins 110 exist on and extend along the center plane CP when the pistons 100 are at the top dead center. Also, an axis of the crankshaft 80 is offset from the center plane CP. This is because a reduction gear is interposed between the crankshaft 80 and the impeller shaft 78.

The cylinder block 90, the cylinder head member 102 and the crankcase member 105 together define an engine body. In the illustrated embodiment, the engine body is oriented in the engine compartment so as to position the crankshaft 80 generally parallel to the central place CP and to extend generally in the longitudinal direction. Other orientations of the engine body, of course, are also possible (e.g., transverse or vertical oriented crankshaft).

The engine 32 includes an air induction system to introduce air to the combustion chambers 104. In the illustrated embodiment, the air induction system includes four air intake passages 116 defined in the cylinder head member 102. The respective intake passages 116 are branched off to three intake paths that are allotted to each combustion chamber 104. The engine 32 thus includes twelve intake paths in total. The intake passages 116 communicate with the associated combustion chambers 104. Intake valves 117, which are the same as the intake paths in number, i.e., twelve valves 117, are provided to selectively connect and disconnect the branch paths with the combustion chambers 104. In other words, the intake valves 117 selectively open and close the branch paths of the intake passages 116.

The air induction system also includes a plenum chamber or air intake chamber 118. The plenum chamber 118 in the illustrated embodiment is generally configured as a rectangular and is defined by a plenum chamber member 120. Other shapes of the plenum chamber of course are also possible, but it is desired to made the plenum chamber as large as possible within the space provided in the engine compartment. In the illustrated embodiment, a layer of space exists between the top of the engine and the bottom of the seat due to the inclined orientation of the engine. The rectangular box-like shape of a principal portion of the plenum chamber member achieves these design parameters in the illustrated embodiment (e.g., side-by-side).

The plenum chamber member 120 comprises an upper chamber member 120*a* and a lower chamber member 120*b* coupled together in a suitable manner. The upper and lower members are made of plastic, although they can be made of metal material. While the illustrated embodiment involves the chamber member being formed by upper and lower chamber members, the chamber member could be formed by a different number of members and/or could have a different assembly orientation.

The lower chamber member 120*b* is coupled with the cylinder head member 102 so that the intake passages 116 communicate with the plenum chamber 118. The plenum chamber 118 extends from one side surface of the cylinder head member 102 toward a space defined between the cylinder head member 102 and the seat 52, i.e., the rider's area of the hull 34, so as to ensure a relatively large volume therein.

Figure 5:
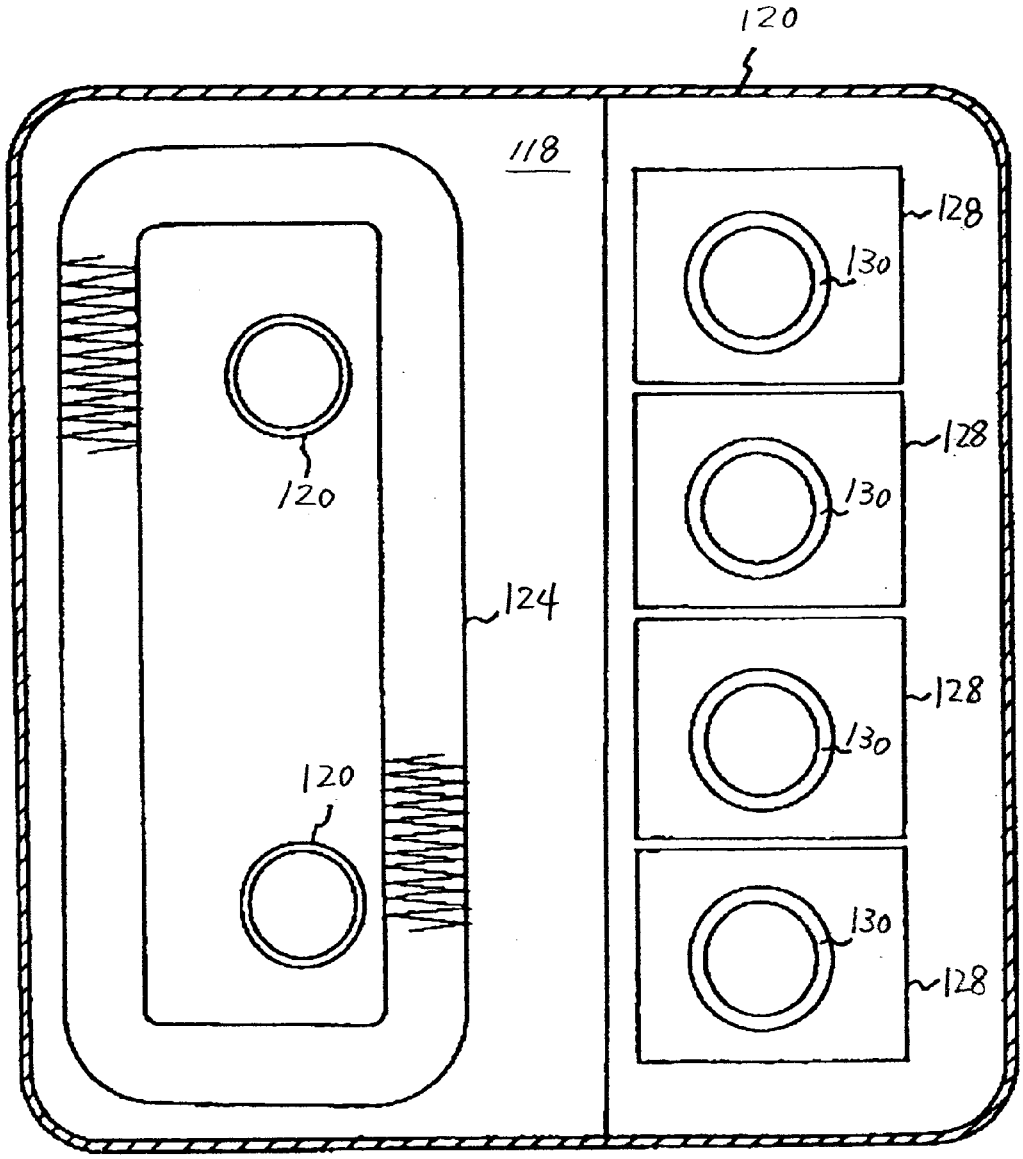
FIG. 5 is a schematic top plan view of the plenum chamber. A plenum chamber member is shown in section taken along the line 5—5 of FIG. 3.
Figure 1:
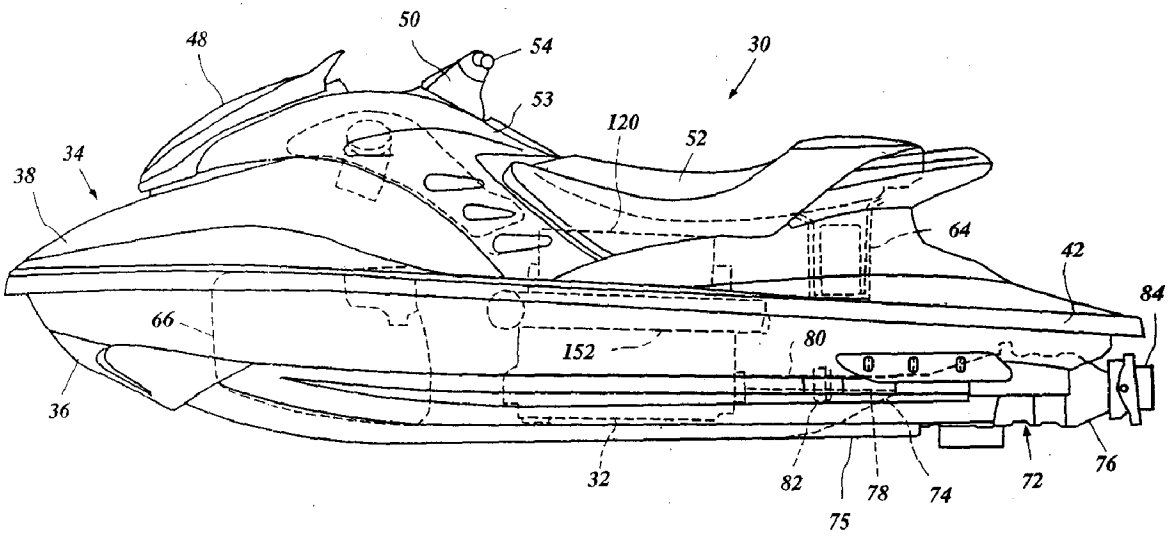
Figure 2:
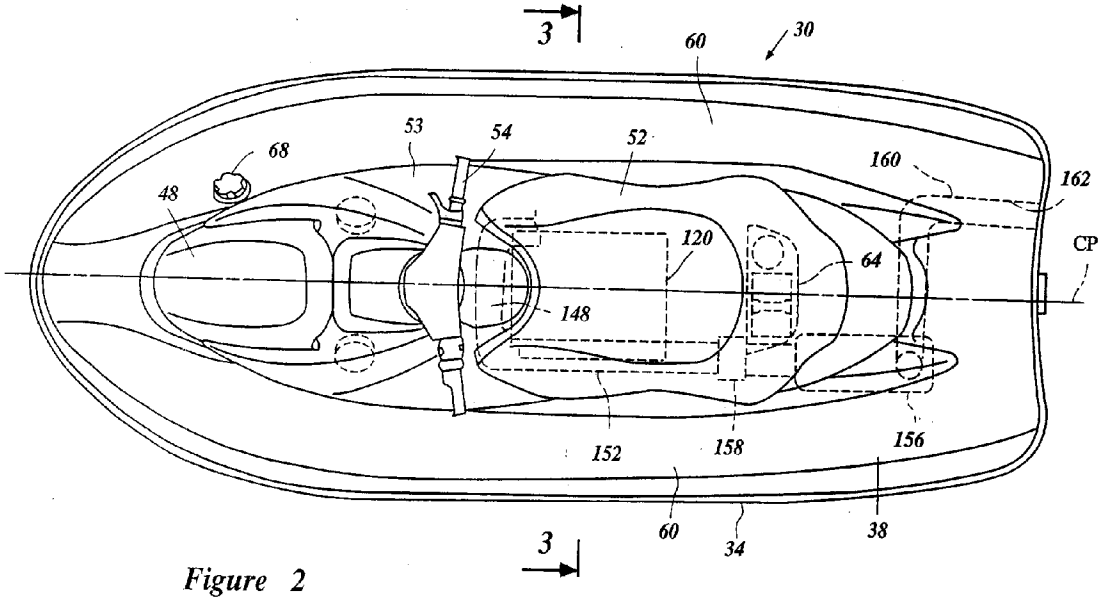
Figure 3:
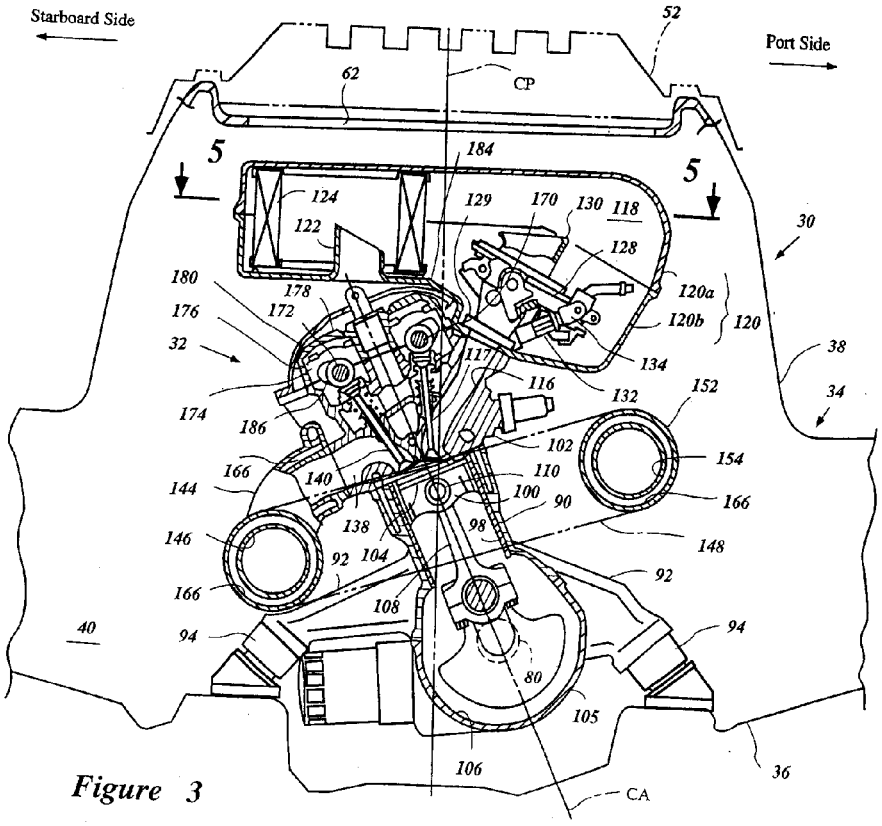
Figure 4:
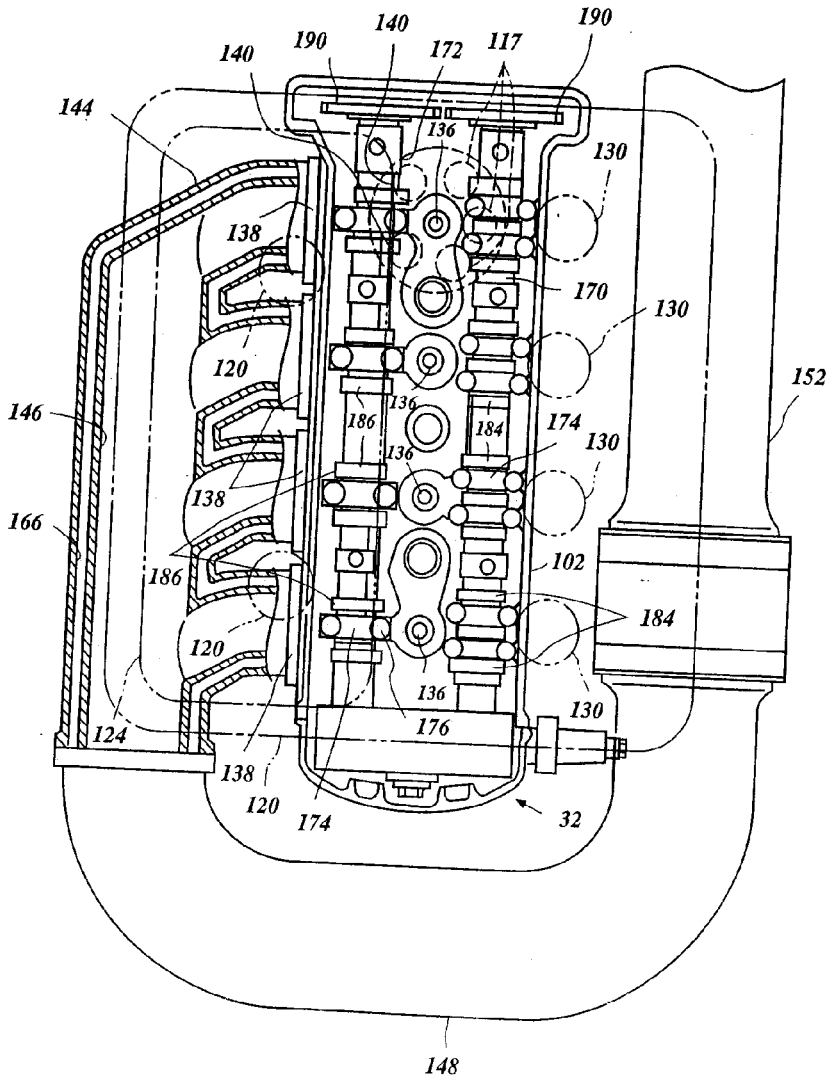

As seen in FIGS. 3 and 5, a pair of air inlet ports 122, each has a duct shape, is defined at a bottom portion of the lower chamber member 120*b* positioned right above the cylinder head member 116. The inlet ports 122 project into the plenum chamber 118. An air cleaner element 124 is disposed within the plenum chamber so as to surround the air inlet ports 120. The air cleaner element 124 divides the plenum chamber 118 into two spaces which are an inner space and an outer space of the element 124. The air inlet ports 122 are positioned in the inner space. The air in the internal cavity 40 of the hull 34 is thus introduced into the plenum chamber 118 and is sure to pass through the cleaner element 124 before moving downstream of the plenum chamber 118.

The air induction system further includes throttle bodies 128 each associated with each one of the combustion chambers 104. In the illustrated embodiment again, the throttle bodies 128 are placed within the plenum chamber 118, more specifically, in the space between the exterior of the cleaner element 124 and the walls of the plenum chamber, and spaced apart from each other along a direction that is parallel to the center plane CP. The throttle bodies 128 project into the plenum chamber 118 so as to lie next to the air inlet ports 122 with a portion of the air cleaner lying therebetween.

As seen in FIG. 3, the air intake passages 116 slant oppositely relative to the center axes CA of the cylinder bores 98. Because they extend along the same axes of the intake passages 116, the throttle bodies 128 also slant oppositely relative to the center axes CA of the cylinder bores 98.

The respective throttle bodies 128 have air suction ports 130, which are shaped as bell mouths, opening upwardly. Throttle valves are provided in the respective throttle bodies 128 and are linked together by a suitable throttle linkage so as to move in unison. The throttle linkage is connected to the throttle lever 56 on the handle bar 54 through a cable. The rider thus can control openings of the throttle valves by operating the throttle lever 56 so as to obtain various running conditions of the engine 32 that he or she desires. That is, an amount of the air is measured by this mechanism and delivered to the respective combustion chambers 104.

Each throttle body 128 has an end flange 129 and is affixed to the cylinder head member 102 at the end flange 129. The lower chamber member 120*b* has a portion that defines an opening, through which the throttle body 128 communicates with the intake passage 116, and this portion of the lower chamber member 120*b* is interposed between the end flange 129 of the throttle body 128 and the cylinder head member 102 so as to be affixed to the cylinder head member 102. Other portions of the lower chamber member 120*b* are also affixed to the cylinder head member 102 in a suitable manner, although those portions are not seen.

The engine 32 also includes a fuel supply system. The fuel supply system includes the foregoing fuel supply tank 66 and fuel injectors 132 that are affixed to a fuel rail 134 and are mounted on the throttle bodies 128. The fuel rail 134 extends generally horizontally in the longitudinal direction in the illustrated embodiment. Because the throttle bodies 128 are disposed within the plenum chamber 118, the fuel injectors 132 are inevitably positioned within the plenum chamber 118. Each fuel injector 132 has an injection nozzle directed toward the intake passage 116 associated with each fuel injector 132.

The fuel supply system includes a low-pressure fuel pump, a vapor separator, a high-pressure fuel pump and a pressure regulator, in addition to the fuel supply tank 66, the fuel injectors 132 and the fuel rail 134. Fuel supplied from the fuel supply tank 66 in the hull 34 is pressurized by the low and delivered to the vapor separator in which the fuel is separated from fuel vapors. One or more high pressure pumps draw the fuel from the vapor separator and pressurize the fuel before it is delivered to the fuel rail. The pressure regulator controls the pressure of the supplied fuel to a preset pressure level. The fuel rail 134 not only supports the fuel injectors 132 but also delivers the fuel to the respective fuel. injectors 132. The fuel injectors 132 spray the fuel into the intake passages 116 at certain injection timings and for certain duration under control of an ECU (Electronic Control Unit).

The sprayed fuel is delivered to the combustion chambers 104 with the air when the intake passages 116 are opened to the combustion chambers 104 by the intake valves 117. The air and the fuel are mixed together in the combustion chambers 104 to form air/fuel charges. Four spark plugs 136 (FIG. 4) are affixed to the cylinder head member 102 so that electrodes of the plugs 136 are exposed to the respective combustion chambers 104. The spark plugs 136 are fired at certain ignition timings under control of the ECU. The air/fuel charge is thus burned during every combustion stroke.

In the illustrated embodiment, as described above, the throttle bodies 128 and the fuel injectors 132 are disposed within the plenum chamber 118. This is advantageous because the plenum chamber 118 can have a larger capacity in comparison with a situation in which the plenum chamber member 120 does not enclose the throttle bodies 128 and the fuel injectors 132. Consequently, the position of the seat 52 can remain the same without reducing the desired volume with the plenum chamber and with the inclusion of the large four-cycle engine in the engine compartment.

In addition, the throttle bodies 128, throttle valves and the fuel injectors 132 are well protected from any water within the engine compartment that splashes onto the plenum chamber member or that may enter the engine compartment when the seat 52 is detached. It is particularly advantageous to isolate these components from the water, especially salt water, as these components involve sensitive mechanical and electrical parts that have precise operation and because they are likely to be damaged by rust and/or corrosion.

The engine 32 has an exhaust system to discharge burnt charges, i.e., exhaust gases, in the combustion chambers 104. In the illustrated embodiment, the exhaust system includes four exhaust passages 138 and the respective exhaust passages 138 are branched off to two exhaust paths that are allotted to each combustion chamber 104. The engine 32 thus includes eight exhaust paths in total. The exhaust passages 138 are defined in the cylinder head member 102 and communicate with the associated combustion chambers 104. Exhaust valves 140, which are the same as the exhaust paths in number, i.e., eight valves 140, are provided to selectively connect and disconnect the branch paths with the combustion chambers 104. In other words, the exhaust valves 140 selectively open and close the branch paths of the exhaust passages 138.

An exhaust manifold 144 is coupled with the exhaust passages 138. In the illustrated embodiment, the exhaust manifold 144 has four unified paths communicating with the respective exhaust passages 138 to gather exhaust gases from the passages 138. The exhaust manifold 144 define a first exhaust passageway 146 including the unified paths. The exhaust manifold 144 extends forwardly and terminates at a forward facing end.

An exhaust conduit or header pipe 148 is coupled with the end 146 of the exhaust manifold 144 and define a second exhaust passageway. As best seen in FIG. 4, the header pipe 148 extends generally transversely across the center plane CP to the opposite side of the engine 32. The header pipe 148 has an end opening directed rearwardly.

An exhaust silencer 152 is coupled with the rearward opening of the header pipe 148 and define a third exhaust passageway 154. The exhaust silencer 152 extends rearwardly along the opposite side surface of the cylinder block 90 relative to the exhaust manifold 144. The exhaust silencer 152 also define an inner structure such as, for example, an expansion chamber, to reduce exhaust noises passing therethrough. As seen in FIG. 3, the header pipe 148 extends upwardly toward the exhaust silencer 152 because the exhaust silencer 152 is positioned higher than the exhaust manifold 144.

As seen in FIG. 2, a water-lock 156 is coupled with the exhaust silencer 152 by a coupling pipe 158, and an exhaust conduit 160 is further coupled with the water-lock 156. The exhaust conduit 160 has a discharge opening 162 located at a submerged portion of the lower hull section 36. The discharge opening 162 is positioned at the end of the exhaust conduit 160 on the same side as the exhaust manifold 144. The exhaust conduit 160 extends forwardly from the discharge opening 162 and then transversely across the center plane CP and connected to the water-lock 156. The water-lock 156 inhibits the water in the exhaust conduit 160 from entering the exhaust pipe 152. Because the water-lock 156 has a relatively large capacity, it may function as an expansion chamber also.

The engine 32 has a water cooling system. The cooling system includes a water pump arranged to introduce water from the body of water surrounding the watercraft 30, and a plurality of water jackets defined, for example, in the cylinder block 90 and the cylinder head member 102. The jet propulsion unit preferably is used as the water pump with a portion of the water pressurized by the impeller being drawn off for the cooling system, as known in the art. Although the water is primarily used for cooling these engine portions, part of the water is used also for cooling the exhaust manifold 144, exhaust pipe 148 and the exhaust silencer 152. The exhaust components 144, 148, 152 are therefore formed as dual passage structures. More specifically, water jackets 166 are defined around the respective exhaust passageways 146, 154.

Still with reference to FIGS. 3 and 4, a valve drive mechanism will be described. In the illustrated embodiment, double overhead camshafts drive the intake and exhaust valves 117, 140. That is, the intake valves 117 are driven by an intake camshaft 170 that extends generally horizontally over the intake valves 117 from fore to aft in parallel to the center plane CP, while the exhaust valve 140 are driven by an exhaust camshaft 172 that extends generally horizontally over the exhaust valves 140 from fore to aft also in parallel to the center plane CP. Both the intake and exhaust camshafts 170, 172 are journaled by the cylinder head member 102 with a plurality of camshaft caps 174. The camshaft caps 174 holding the camshafts 170, 172 are affixed to the cylinder head member 102 by bolts 176. A camshaft cover 178 extends over the camshafts 170, 172 and the camshaft caps 174, and is affixed to the cylinder head member 102 to define camshaft chambers. Additionally, a cylinder head cover 180 extends over the camshaft cover 178 and is affixed to the cylinder head member 102.

The intake camshaft 170 has twelve cam lobes 184 each associated with each one of the intake valves 117, while the exhaust camshaft 172 has eight cam lobes 186 each associated with each one of the exhaust valve 140. The intake and exhaust valves 117, 140 normally close the intake and exhaust passages 116, 138 by biasing force of springs. When the intake and exhaust camshafts 170, 172 rotate, the cam lobes 184, 186 push the respective valves 117, 140 to open the respective passages 116, 138 by overcoming the biasing force. The air thus can enter the combustion chambers 104 at every opening timing of the intake valves 117. In the same manner, the exhaust gases can move out from the combustion chambers 104 at every opening timing of the exhaust valves 140.

The crankshaft 80 drives the intake and exhaust camshafts 170, 172. As seen in FIG. 4, the respective camshafts 170, 172 have driven sprockets 190 affixed to ends thereof. The crankshaft 80 also has a drive sprocket. The driven sprockets 190 have diameters which are twice as large as a diameter of the drive sprocket. A timing chain or belt is wound around the drive and driven sprockets 190. When the crankshaft 80 rotates, the drive sprocket drives the driven sprockets 190 via the timing chain, and then the intake and exhaust camshafts 170, 172 rotate also. The rotational speed of the camshafts 170, 172 are reduced to half as the rotational speed of the crankshaft 80 because of the differences in diameters of the drive and driven sprockets 190.

Ambient air enters the internal cavity 40 defined in the hull 34 through the air intake ducts. The air is then introduced into the plenum chamber 118 through the air inlet ports 123 and moves to the throttle bodies 128. The air cleaner element 124 cleans the air. The throttle valves in the throttle bodies 128 regulate an amount of the air permitted to pass to the combustion chambers. Changing the opening angles of the throttle valves that are controlled by the rider with the throttle lever 56 regulates the air flow across the valves. The air hence flows into the combustion chambers 104 when the intake valves open. At the same time, the fuel injectors 132 spray fuel into the intake passages 116 under the control of ECU. Air/fuel charges are thus formed and delivered to the combustion chambers 104.

The air/fuel charges are fired by the spark plugs 136 under the control of the ECU. The burnt charges, i.e., exhaust gases, are discharged to the body of water surrounding the watercraft 30 through the exhaust system including the exhaust passages 138, exhaust manifold 144, exhaust pipe 148, exhaust silencer 152, water-lock 158 and exhaust conduit 160.

The combustion of the air/fuel charges has the pistons 100 reciprocate to rotate the crankshaft 80. The crankshaft 80 drives the impeller shaft 78 and the impeller rotates in the hull tunnel 74. Water is thus drawn into the tunnel 74 through the inlet port 76 and then is discharged rearward through the steering nozzle 84. The rider can steer the nozzle 84 by the steering handle bar 54. The watercraft 30 thus moves as the rider desires.

As best seen in FIG. 3, in the illustrated embodiment, all the valves 117, 140 and the camshafts 170, 172 are positioned in one half space of the hull 30 divided by the center plane CP. More specifically, the internal cavity 40 defined by both the upper and lower hull sections 36, 38 is divided by the center plane CP into two cavity spaces. The valves 117, 140 and the camshafts 170 , 172 are placed in one of these spaces. The group of the intake valves 117 and the intake camshaft 170, which are heavier than the other group of the exhaust valves 140 and the exhaust camshaft 172, exist closer to the center plane CP.

In other variations, for example, the intake valves 117 can be disposed in the other space wholly or partially. The intake camshafts 170 can be also positioned in the other space, if top portions of the intake valves 117 exist in the cavity space. In this variation, the heavier group exists in the other space but closer to the center plane CP than the other group. The moment of the heavier group thus can balance the moment of the lighter group relative to the center plane CP. This arrangement thus can contribute in balancing the weights of both sides of the hull.

Also, if the exhaust valves 140 are greater than the intake valves 117 in number, the positions of the exhaust valves 140 are changeable with the intake valves 117. In any instance, however, if the center axis CA of the cylinder bores 98 inclines relative to the center plane CP, the valves which are greater than the other valves in number desirably exist closer to the center plane CP.

Of course, the foregoing description is that of a preferred embodiment of the present invention, and various changes and modifications may be made without departing from the spirit and scope of the invention, as defined by the appended claims.

What is claimed is:

1. An internal combustion engine for a watercraft having a hull defining an engine compartment in which the engine is placed, comprising a cylinder block defining at least one cylinder bore, a piston reciprocating within the cylinder bore, a cylinder head member closing an end of the cylinder bore and defining a combustion chamber with the cylinder bore and the piston, an air induction system arranged to introduce air to the combustion chamber, the air induction system including a plenum chamber member defining a plenum chamber, the plenum chamber member having an air inlet port for the plenum chamber, a throttle body having a throttle valve admitting air to the combustion chamber from the plenum chamber, the throttle body being disposed within the plenum chamber, and an air intake passage extending from the throttle body to the combustion chamber, the intake passage not being defined by a portion of the plenum chamber, and a fuel supply system arranged to supply fuel to the combustion chamber, the fuel supply system including a fuel injector spraying fuel into a portion of the air induction system, and the fuel injector being positioned within the plenum chamber.

2. The internal combustion engine as set forth in claim 1, wherein the throttle body projects into the plenum chamber downstream the air inlet port.

3. The internal combustion engine as set forth in claim 2, wherein the air inlet port projects into the plenum chamber so as to be disposed next to the throttle body within the plenum chamber.

4. The internal combustion engine as set forth in claim 1, wherein the plenum chamber member encloses an air cleaner element for cleaning the air disposed between the air inlet port and the throttle body.

5. The internal combustion engine as set forth in claim 1, wherein the fuel injector is mounted on the throttle body.

6. The engine as set forth in claim 1, wherein the plenum chamber is configured to protect the throttle body from water within the engine compartment.

7. The engine as set forth in claim 1 in combination with a watercraft.

8. An internal combustion engine for a watercraft having a hull defining an engine compartment in which the engine is placed, comprising a cylinder block defining at least one cylinder bore, a piston reciprocating within the cylinder bore, a cylinder head member closing an end of the cylinder bore and defining a combustion chamber with the cylinder bore and the piston, an air induction system arranged to introduce air to the combustion chamber, the air induction system including a plenum chamber member defining a plenum chamber, the plenum chamber member having an air inlet port for the plenum chamber, and a throttle body having a throttle valve admitting air to the combustion chamber from the plenum chamber, the throttle body being disposed within the plenum chamber, the cylinder head member having an air intake passage connecting the throttle body to the combustion chamber, the plenum chamber member comprising at least two pieces, one of the pieces having both the air inlet port and a coupling portion of the throttle body with the air intake passage.

9. An internal combustion engine for a watercraft having a hull defining an engine compartment in which the engine is placed, comprising a cylinder block defining at least one cylinder bore, a piston reciprocating within the cylinder bore, a cylinder head member closing an end of the cylinder bore and defining a combustion chamber with the cylinder bore and the piston, an air induction system arranged to introduce air to the combustion chamber, the air induction system including a plenum chamber member defining a plenum chamber, the plenum chamber member having an air inlet port for the plenum chamber, and a throttle body having a throttle valve admitting air to the combustion chamber from the plenum chamber, the throttle body being disposed within the plenum chamber, the cylinder head member having an air intake passage connecting the throttle body to the combustion chamber, the plenum chamber member extending from a coupling portion of the throttle body with the air intake passage toward a top of the cylinder head member, the air inlet port being positioned generally above the top of the cylinder head member.

10. An internal combustion engine for a watercraft having a hull defining an engine compartment in which the engine is placed, comprising a cylinder block defining at least one cylinder bore, a piston reciprocating within the cylinder bore, a cylinder head member closing an end of the cylinder bore and defining a combustion chamber with the cylinder bore and the piston, an air induction system arranged to introduce air to the combustion chamber, the air induction system including a plenum chamber member defining a plenum chamber, the plenum chamber member having an air inlet port for the plenum chamber, a throttle body having a throttle valve admitting air to the combustion chamber from the plenum chamber, the throttle body being disposed within the plenum chamber, and an air intake passage extending from the throttle body to the combustion chamber, the intake passage not being defined by a portion of the plenum chamber, the engine operating on a four-stroke cycle combustion principle.

11. A watercraft comprising a hull defining an engine compartment and a rider's area above the engine compartment, and an internal combustion engine disposed within the engine compartment, the engine including an engine body in which a combustion chamber is defined, the engine body slanting relative to a vertical plane extending from bow to stern, and an air induction system arranged to introduce air to the combustion chamber, the air induction system including a plenum chamber member, a throttle body, and an intake passage extending from the throttle body to the combustion chamber, the plenum chamber member defining a plenum chamber and having an air inlet port, the throttle body having a throttle valve admitting air to the combustion chamber from the plenum chamber, the throttle body being positioned within the plenum chamber, the throttle body extending from a side surface of the engine body and slanting oppositely relative to a slant of the engine body, the intake passage not being defined by a potion of the plenum chamber.

12. A watercraft comprising a hull defining an engine compartment and a rider's area above the engine compartment, and an internal combustion engine disposed within the engine compartment, the engine including an engine body in which a combustion chamber is defined, and an air induction system arranged to introduce air to the combustion chamber, the air induction system including a plenum chamber member, a throttle body, and an intake passage extending from the throttle body to the combustion chamber, the plenum chamber member defining a plenum chamber and having an air inlet port, the plenum chamber member extending from a side surface of the engine body toward a space defined between the engine body and the rider's area of the hull, the throttle body having a throttle valve admitting air to the combustion chamber from the plenum chamber, the throttle body being positioned within the plenum chamber, the intake passage not being defined by a potion of the plenum chamber.

13. The watercraft as set forth in claim 12, wherein the hull has an opening at the rider's area above the engine body, and a seat for a rider detachably closes the opening.

14. An internal combustion engine for a watercraft having a hull defining an engine compartment in which the engine is placed, comprising a cylinder block defining at least one cylinder bore, a piston reciprocating within the cylinder bore, a cylinder head member closing an end of the cylinder bore and defining a combustion chamber with the cylinder bore and the piston, an air induction system arranged to introduce air to the combustion chamber, the air induction system including a plenum chamber member defining a plenum chamber, the plenum chamber member having an air inlet port for the plenum chamber, the plenum chamber member being sized so as to extend from a side surface of the engine toward a space defined between the engine and a rider's area of the hull, a throttle body having a throttle valve admitting air to the combustion chamber from the plenum chamber, the throttle body being disposed within the plenum chamber, and an air intake passage extending from the throttle body to the combustion chamber, wherein the intake passage is not defined by a portion of the plenum chamber.

15. An internal combustion engine comprising an engine body in which a combustion chamber is defined, an air induction system arranged to guide air to the combustion chamber, the air induction system including a plenum chamber member defining a plenum chamber, the plenum chamber member having an air inlet port for the plenum chamber, a throttle body having a throttle valve and being disposed within the plenum chamber, and an air intake passage extending from the throttle body to the combustion chamber, the intake passage not being defined by a portion of the plenum chamber, and a fuel supply system arranged to supply fuel to the combustion chamber, the fuel supply system including a fuel injector spraying fuel into a portion of the air induction system, and the fuel injector being positioned within the plenum chamber.

16. The engine as set forth in claim 15, wherein the plenum chamber is configured to protect the throttle body from water.

17. The engine as set forth in claim 15, wherein the plenum chamber surrounds the throttle body and thereby encloses a large volume of space.

18. A watercraft comprising a hull, an internal combustion engine supported by the hull, the engine including an engine body in which a combustion chamber is defined, an air induction system configured to guide air to the combustion chamber, the air induction system including a plenum chamber, a throttle body disposed in the plenum chamber, and an intake passage extending from the throttle body to the combustion chamber, the intake passage not being defined by a potion of the plenum chamber, and a fuel supply system arranged to supply fuel to the combustion chamber, the fuel supply system including a fuel injector spraying fuel into a portion of the air induction system, and the fuel injector being positioned within the plenum chamber.

19. The watercraft as set forth in claim 18, wherein the plenum chamber is configured to protect the throttle body from water splashing in the hull.

* * * * *

UNITED STATES PATENT AND TRADEMARK OFFICE

CERTIFICATE OF CORRECTION

PATENT NO. : 6,478,002 B1
DATED : November 12, 2002
INVENTOR(S) : Tetsuya Mashiko It is certified that error appears in the above-identified patent and that said Letters Patent is hereby corrected as shown below:

Drawings,
Please insert the following drawings:

Signed and Sealed this

Seventeenth Day of August, 2004

JON W. DUDAS
*Acting Director of the United States Patent and Trademark Office*